US008453263B2

(12) United States Patent
Wortman

(10) Patent No.: US 8,453,263 B2
(45) Date of Patent: Jun. 4, 2013

(54) SYSTEM TO IMPROVE SWINGING MOTION

(76) Inventor: A. Alex Wortman, Ann Arbor, MI (US)

( * ) Notice: Subject to any disclaimer, the term of this patent is extended or adjusted under 35 U.S.C. 154(b) by 87 days.

(21) Appl. No.: 13/032,161

(22) Filed: Feb. 22, 2011

(65) Prior Publication Data

US 2011/0277208 A1 Nov. 17, 2011

Related U.S. Application Data

(60) Provisional application No. 61/333,958, filed on May 12, 2010.

(51) Int. Cl.
*A63B 69/36* (2006.01)
*A63B 57/00* (2006.01)

(52) U.S. Cl.
USPC ..... 2/77; 2/69; 2/243.1; 2/253; 2/272; 473/207; 473/215; 473/276; 473/277

(58) Field of Classification Search
USPC ..... 2/69, 77, 243.1, 247–253, 272
See application file for complete search history.

(56) References Cited

U.S. PATENT DOCUMENTS

| | | | | | |
|---|---|---|---|---|---|
| 1,655,092 | A * | 1/1928 | Brown | 473/212 |
| 2,498,006 | A * | 2/1950 | Ridill | 473/217 |
| 3,106,718 | A * | 10/1963 | Raab | 473/214 |
| 3,672,682 | A * | 6/1972 | Yanagidaira | 473/276 |
| 3,951,416 | A * | 4/1976 | Koch et al. | 473/212 |
| 4,045,033 | A * | 8/1977 | Schuman | 473/266 |
| 4,058,852 | A * | 11/1977 | Aragona | 2/115 |
| 4,593,909 | A * | 6/1986 | Anselmo et al. | 473/216 |
| 4,892,317 | A * | 1/1990 | Corder, Jr. | 473/212 |
| 4,896,887 | A * | 1/1990 | Cable | 473/212 |
| 5,016,885 | A * | 5/1991 | Quigley | 473/217 |
| 5,096,199 | A * | 3/1992 | Wyatt et al. | 473/212 |
| 5,203,567 | A * | 4/1993 | Erlinger et al. | 473/276 |
| 5,390,929 | A * | 2/1995 | Todaro | 473/215 |
| 5,451,060 | A * | 9/1995 | Dalbo | 473/215 |
| 5,501,464 | A * | 3/1996 | Dalbo | 473/213 |
| 5,518,480 | A * | 5/1996 | Frappier | 482/124 |
| 5,529,306 | A * | 6/1996 | Staats et al. | 473/208 |
| 5,795,238 | A * | 8/1998 | Nicholson | 473/214 |
| 5,839,968 | A * | 11/1998 | Latella | 473/219 |
| 6,176,790 | B1 * | 1/2001 | Latella | 473/219 |
| 6,620,052 | B2 * | 9/2003 | Piatt | 473/208 |
| 6,939,246 | B1 * | 9/2005 | Minichino et al. | 473/274 |
| 7,314,437 | B2 * | 1/2008 | Frappier | 482/124 |
| 7,585,229 | B2 * | 9/2009 | Kelley | 473/276 |
| 7,976,398 | B2 * | 7/2011 | Clawson | 473/212 |
| 2009/0258719 | A1 * | 10/2009 | Wortman | 473/221 |
| 2011/0277208 | A1 * | 11/2011 | Wortman | 2/69 |

* cited by examiner

*Primary Examiner* — Bobby Muromoto, Jr.
(74) *Attorney, Agent, or Firm* — Brinks Hofer Gilson & Lione

(57) ABSTRACT

A shirt for improving a swinging motion of a user wearing the shirt includes front and rear panels each having corresponding top, bottom and generally opposing side edges, wherein the front and rear panels are adjoined to each other by the top and side edges, defining an interior space of the shirt. The front and rear panels include sleeve cutouts formed on each side edge adjacent the top edge, and a neck cutout formed on the top edges of the front and rear panels. At least one tubular sleeve is permanently joined to the front and rear panels of at least one of the sleeve cutouts, the tubular sleeve defining an inside area, the inside area being fluidly connected to the interior space of the shirt. A member is substantially adjacent to the sleeve cutout and the side edges of both the front and rear panels.

10 Claims, 5 Drawing Sheets

SYSTEM TO IMPROVE SWINGING MOTION

CROSS-REFERENCE TO A RELATED APPLICATION

This application claims priority to U.S. provisional patent application No. 61/333,958, entitled "System to Improve Swinging Motion" filed on May 12, 2010, the entirety of which is hereby incorporated by reference as if set forth fully herein.

BACKGROUND

1. Field of the Invention

The invention generally relates to sports training devices for improving a swinging motion of a user, especially a swinging motion relating to the sport of golf.

2. Description of Related Art

Golf, like other sports that require an arm swinging motion, is a sport that requires a significant amount of finesse. As a golfer swings at a golf ball, even the slightest variation of the golfer's swing can affect the distance and direction the golf ball travels. As it is well known, golfers spend significant amounts of time and resources to improve their swinging performance.

It has been observed that golfers, especially untrained golfers, when attempting to hit the golf ball, struggle to produce a proper and effective swing path. On the back swing, there is a tendency for untrained golfers to not make a suitable full shoulder turn. On the down swing, there is a tendency for untrained golfers to go "over-the-top." An "over-the-top" swing is a swing from the outside to the inside of a target line. Finally, there is a tendency for untrained golfers to not finish the full swing cycle by completely following the swing through.

Prior art solutions are generally limited to personal trainers or cumbersome training devices that are not suitable for everyday use. Some of these cumbersome devices are embarrassing to use in public, as they required the user to wear an apparatus that was readily noticeable as a training device. Additionally, because these prior art devices are not suitable for everyday use, golfers, especially untrained golfers, do not receive the constant feedback necessary to develop a proper golf swing.

SUMMARY

A shirt for improving a swinging motion of a user wearing the shirt includes front and rear panels each having corresponding top, bottom and generally opposing side edges, wherein the front and rear panels are adjoined to each other by the top and side edges, defining an interior space of the shirt. The front and rear panels include sleeve cutouts formed on each side edge and adjacent to the top edge. The shirt also includes a neck cutout formed on the top edges of the front and rear panels. At least one tubular sleeve is permanently attached to the front and rear panels of at least one of the sleeve cutouts, the tubular sleeve defining an inside area, the inside area being fluidly connected to the interior space of the shirt. A member is substantially adjacent to the sleeve cutout and the side edges of the front and/or rear panels.

Further objects, features and advantages of this invention will become readily apparent to persons skilled in the art after a review of the following description, with reference to the drawings and claims that are appended to and form a part of this specification.

DETAILED DESCRIPTION

Figure 1:
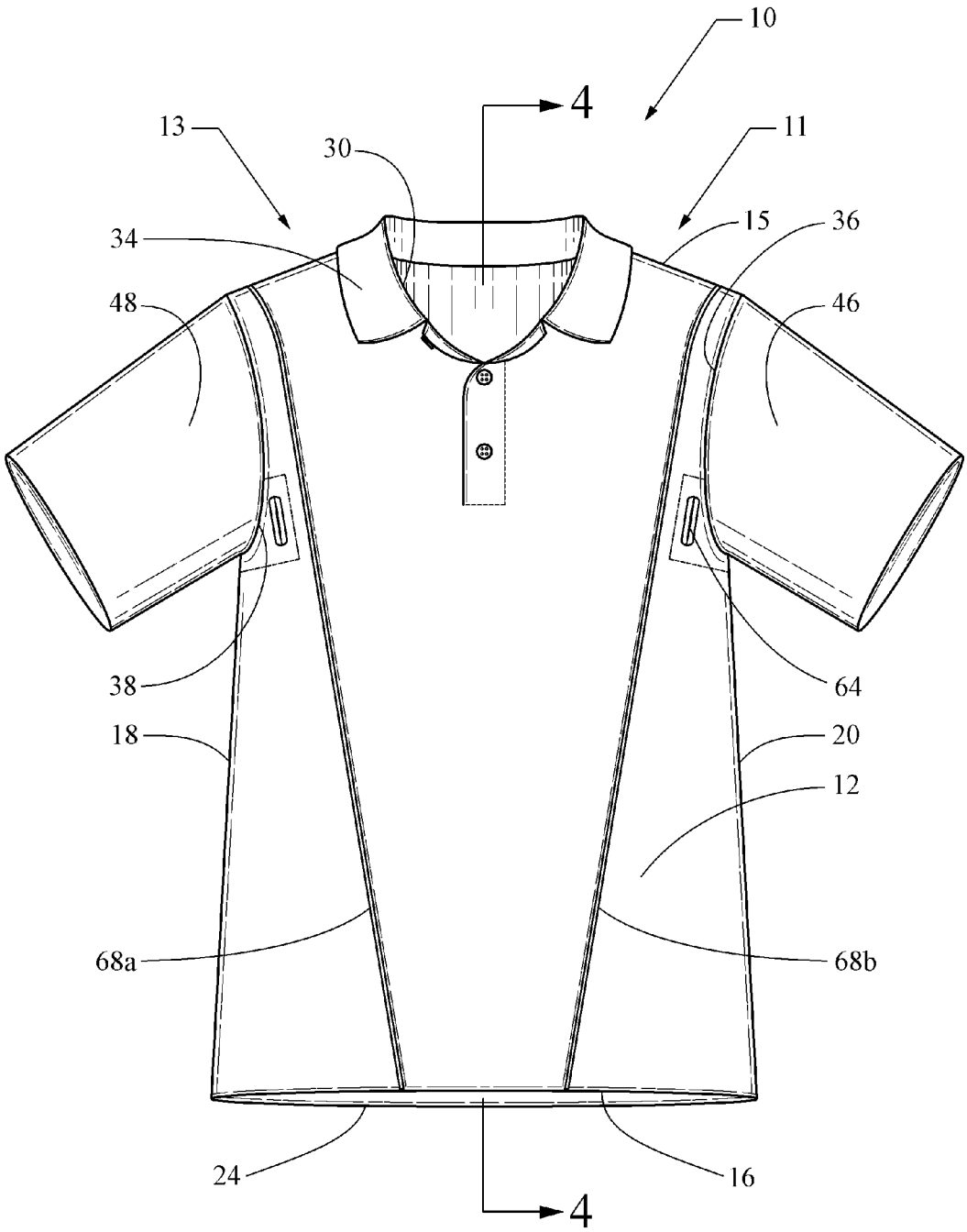
FIG. 1 illustrates a front view of a shirt for improving a swinging motion of a user wearing the shirt.
Figure 2:
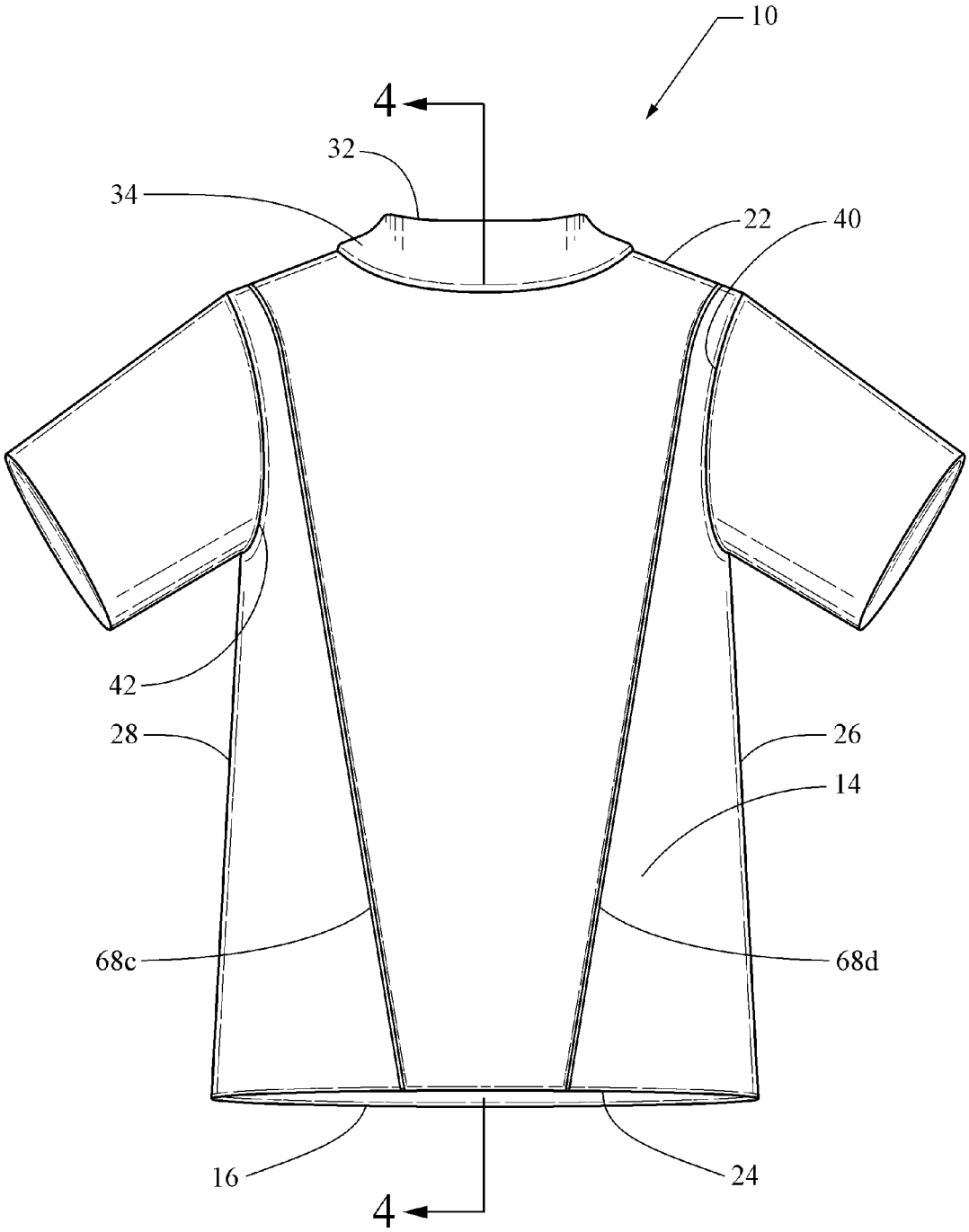
FIG. 2 illustrates a back view of the shirt of FIG. 1.
Figure 3:
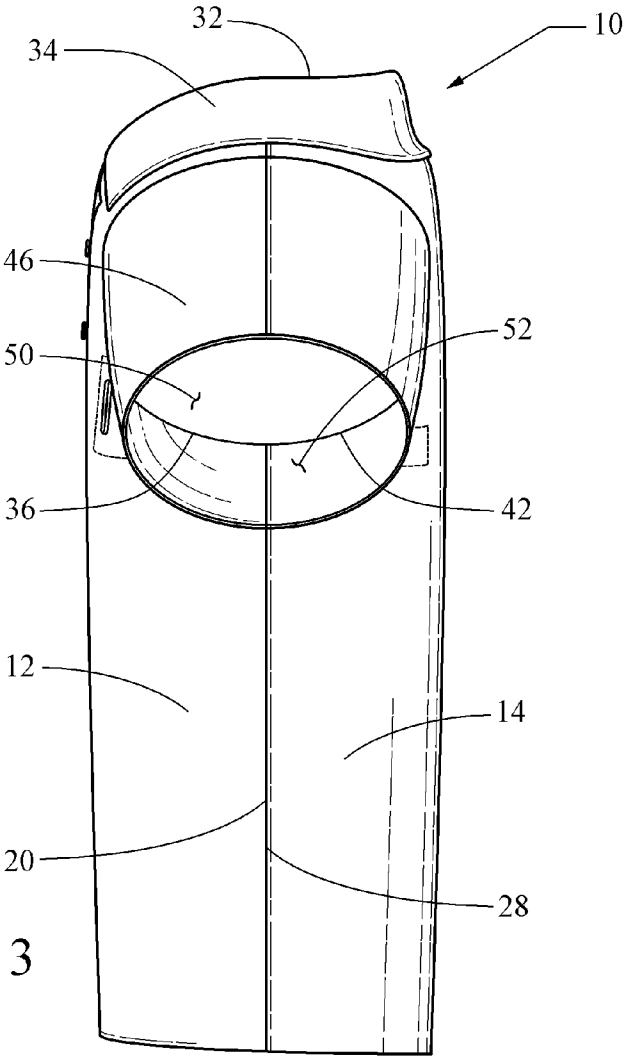
FIG. 3 illustrates a side view of the shirt of FIGS. 1 and 2.

Referring to FIGS. 1, 2, and 3, a shirt 10 for improving a swinging motion of a user wearing the shirt 10 is shown. As shown in FIGS. 1 and 3, the shirt 10 has a front panel 12. As best shown in FIGS. 2 and 3, the shirt also has a back panel 14. The front panel 12 has a top edge 15, a bottom edge 16, and generally opposing side edges 18 and 20. The rear panel 14 is similar to the front panel 12, in that the rear panel 14 also has a top edge 22, a bottom edge 24, and generally opposing side edges 26 and 28. The top edge 15 of the front panel 12 has a neck cutout 30. Similarly, the top edge 22 of the back panel 14 also has a neck cutout 32. It should be understood while the shirt 10 may be made of separate panels of cloth or other suitable materials; it is possible that the shirt 10 can be made of panels from a single unitary piece of material, such as a seamless design. For example, the front panel 12 and rear panel 14 may be made of a single continuous piece of material, without any seams between the front panel 12 and the rear panel 14.

The top edge 15 of the front panel is adjoined to the top edge 22 of the rear panel 14. Generally, the neck cutouts 30 and 32 are not adjoined to each other, so as to generally define an opening along the top edges 15 and 22 of the shirt 10, thereby allowing a neck of a user to protrude through the opening. Additionally, the shirt 10 may include a collar 34 adjacent to the neck cutouts 30 and 32.

The front panel 12 also has sleeve cutouts 36 and 38 located adjacent to the side edges 20 and 18 of the front panel 12 of the shirt 10. Similarly, the back panel 14 also has sleeve cutouts 40 and 42 located on the side edges 26 and 28 of the back panel 14 of the shirt 10.

The side edge 20 of the front panel 12 is adjoined to the side edge 28 of the back panel 14 of the shirt 10. However, the sleeve cutouts 36 and 42 are not adjoined, therefore defining an opening for a left arm of the user to protrude through. Similarly, the side edge 18 of the front panel 12 is adjoined to the side edge 26 of the back panel 14, except where the sleeve cutouts 38 and 42 are located, defining an opening. This allows the right arm of the user of the shirt 10 to protrude through this opening.

The shirt 10 also includes a tubular sleeve 46 that is adjoined to the sleeve cutouts 36 and 42. The shirt 10 may also include a second tubular sleeve 48 adjoined to the sleeve cutouts 38 and 40. The tubular sleeves 46 and 48 are in fluid communication with an interior space 50 of the shirt 10 that is located between the front panel 12 and the back panel 14.

As shown in FIG. 3, the interior space 50 is shown looking down the sleeve cutout 46 of the shirt 10. This interior space is located between the front panel 12 and the back panel 14 of the shirt 10 and is in fluid communication with an inside area 52 of the sleeve cutout 46.

Figure 4:
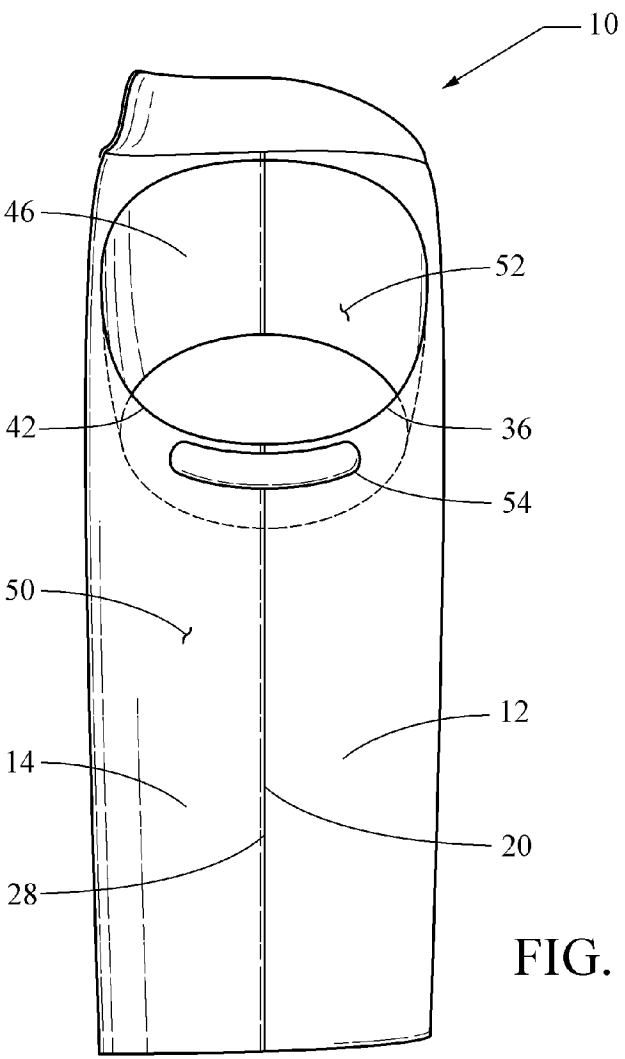
FIG. 4 illustrates an interior view of the shirt of FIGS. 1-3, generally taken along lines 4-4 of FIG. 1.

As can be generally seen in FIGS. 1 and 2, the shirt 10, essentially has two halves—a left half 11 and a right half 13, generally divided by lines 4-4. Referring to FIG. 4, this figure illustrates a cutaway view generally taking along lines 4-4 of FIG. 1. Generally, this view may be equally applicable in the opposite direction, as the shirt 10 is generally a mirror image along lines 4-4 of FIG. 1. Therefore, elements discussed in the following paragraphs may be applicable to both halves 11 and 13 of the shirt 10, but may be only incorporated on one or both halves 11 and 13 of the shirt 10.

Still referring to FIG. 4, it can be better seen that the inside area 52 of the tubular sleeve 46 is in fluid communication with interior space 50 of the shirt 10. Additionally, a member 54 is located substantially adjacent to the sleeve cutouts 36 and 42 and also the side edges 20 and 28 of the front panel 12 and rear panel 14.

Figure 7A:
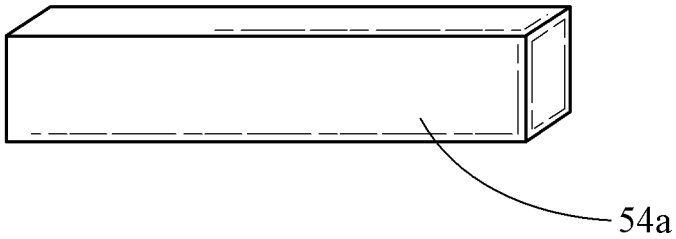
FIGS. 7*a*, 7*b*, and 7*c* illustrate different embodiments of a member.
Figure 7B:
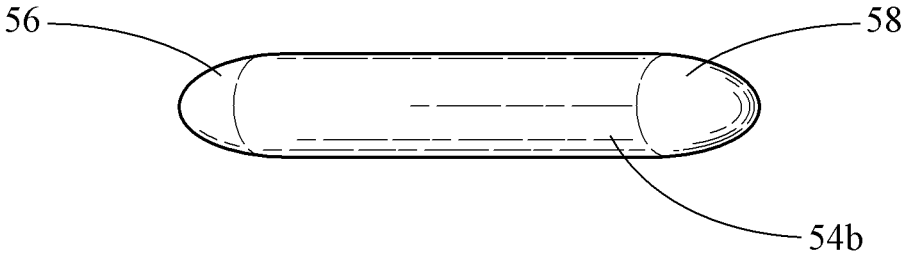
Figure 7C:
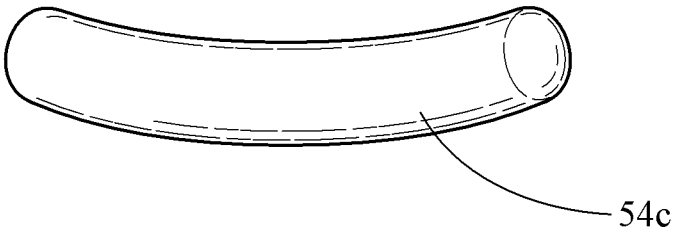

Referring to FIGS. 7*a*, 7*b*, and 7*c*, these figures illustrate different variations of the member 54. In FIG. 7*a*, the member 54*a* is substantially rectangular in shape. In FIG. 7*b*, the member 54*b* has ends 56 and 58 that taper. Finally, in FIG. 7*c*, the member 54*c* has a generally circular curvature that generally corresponds to the edges of sleeve cutouts 36 and 42. However, it should be understood that the member 54 may comprise any one of a number of different shapes.

Further, it should be understood that the member 54 may be made out of a number of different materials that may be flexible in nature, such as foam or may be a flexible capsule filled in part with a flexible material. Additionally, the flexible member 54 may be an inflatable system, wherein the flexible member 54 inflates to a specified shape.

However, the member 54 may also be made of a non-flexible material, entirely or in additional to a non-flexible material. Such materials may include plastic, wood, cork, wire mesh, tin or any other type of solid material. Further, the member 54 may be an oversized golf tee or pencil or any other suitable device. The member 54 may be a non-flexible material wrapped with a flexible material.

Further, the member 54 may be an electronic device that emits a beep (audible), light (visual), or vibration (tactile) when in contact or not in contact with the user of the shirt 10. For example, the member 54 may be a pen-like shaped device that lights, vibrates, and/or beeps.

Referring back to FIG. 4, the member 54 may be permanently attached to the shirt 10 through the use of any number of adhesives. Additionally, the flexible member may be attached to the shirt 10 by stitching the member 54 to the shirt 10. Further, the member 54 may be attached to the shirt 10 through the use of a removable attachment system, such as a hook and loop fastener.

Figure 5:
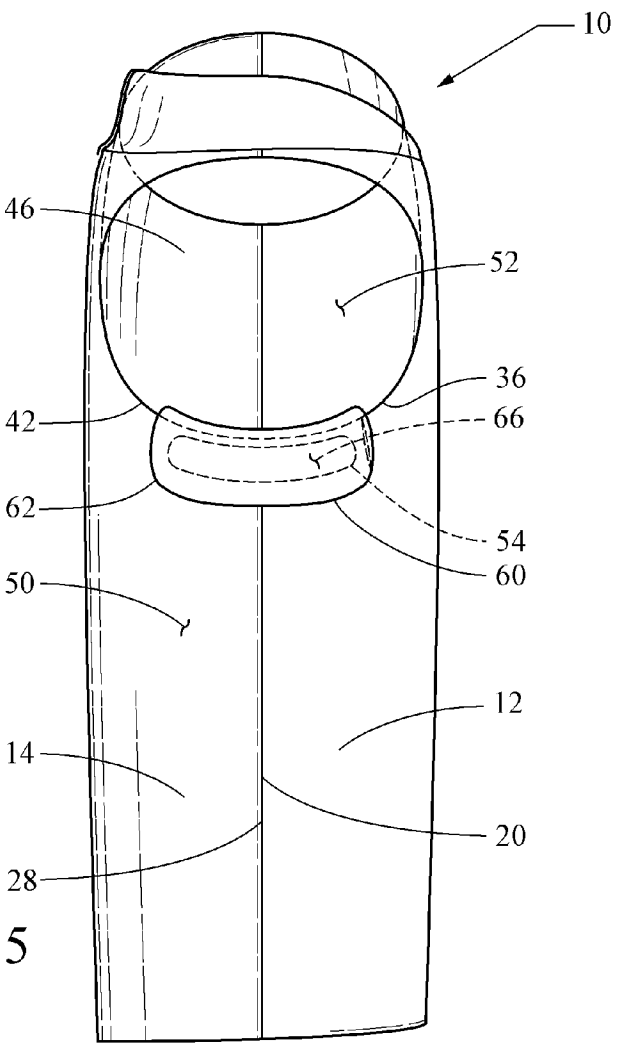
FIG. 5 illustrates another view of the interior section of the shirt of FIG. 4.

Referring to FIG. 5, another embodiment of attaching the flexible member 54 to the shirt 10 is shown. In this embodiment, a pouch 60 having edges 62 is shown. The edges 62 of the pouch 60 may be attached to the sleeve 46, the rear panel 14, and the front panel 12, generally in an area where the sleeve cutouts 36 and 42 meet with the edges 20 and 28 of the front and rear panels 12 and 14, respectively. By so doing, the member 54 may be encapsulated by the pouch 60 and portions of the sleeve 46, front panel 12, and rear panel 14.

Referring to FIGS. 1 and 5, the front panel of the shirt 10 may have an opening 64 in fluid communication with the space 66 defined between the pouch 60 and the tubular sleeve 46, front panel 12, and rear panel 14. The opening 64 allows for quick and easy insertion or removal of the member 54, thereby providing the golfer with the benefit of wearing a shirt that is indeed 'convertible'. By allowing the easy removability or insertabilty of the member 54 via the opening 64, the golfer is given choices. He can for example choose to use shirt 10, with member 54 inserted, as a 'training shirt' when he is on the practice range. Then without having to change into a different shirt, the golfer can then easily and quickly remove member 54 via opening 64, and continue to wear the same shirt 10 as his 'regular golf shirt' as he begins an official round of play (possibly a requirement in case golf rules dictate that the use of such a member 54 would violate golf rules). Additionally, the easy removability or insertability of the member 54 via the opening 64 allows the user of the shirt 10 to easily and temporarily practice swinging without the use of the member 54, eventually allowing the golfer to groove and habituate his swing path without the use of member 54

Additionally, the front panel 12 of the shirt 10 may also include a series of design lines 68*a* and 68*b* that extend substantially from the top edge 15 of the front panel 12 towards the bottom edge 16 of the front panel 12. Referring to FIG. 2, the rear panel 14 of the shirt 10 may also have design lines 68*c* and 68*d* extending from the top edge 22 of the rear panel 14 of the shirt 10 to the bottom edge 24 of the rear panel 14 of the shirt 10.

The design lines 68*a* and 68*b* also provide a function in that they add a benefit to the inventive golf shirt 10. As the golfer wearing the shirt 10 addresses the ball, the design lines 68*a* and 68*b* guide/map/cue the golfer's position, signaling for him an awareness of the triangular hanging/shaping of the arms. For example, the design line 68*b* becomes another visual point of awareness as the golfer is cued/mapped/guided into a full backswing turn with the shoulder meeting the golfer's chin. The design line 68*a* becomes another point of awareness as the golfer is visually cued/guided/mapped into a full finishing 'swing-through'.

Figure 6:
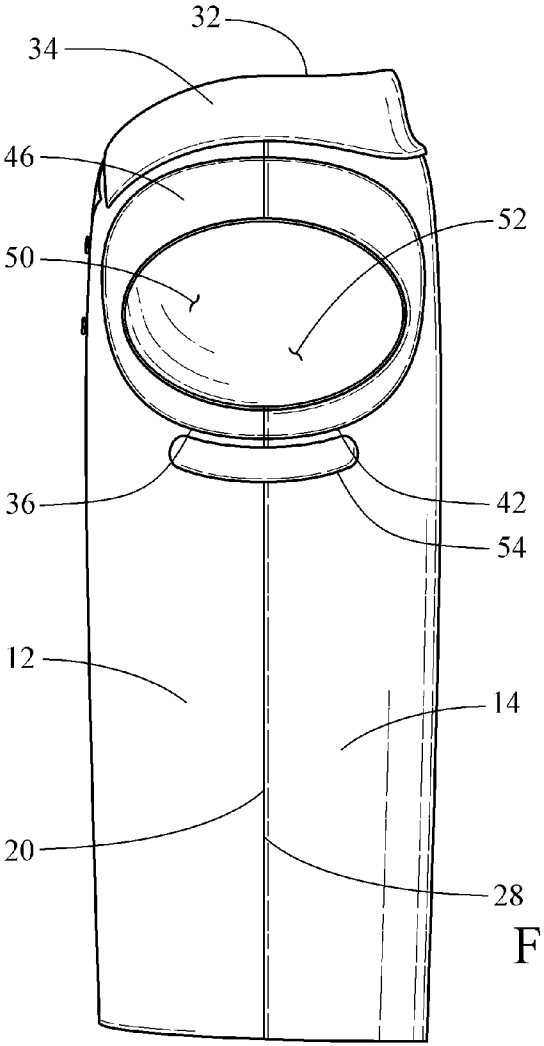
FIG. 6 illustrates another side view of the shirt of FIG. 1 having a member located on the outside of the shirt.

Referring to FIG. 6, another embodiment of the shirt 10 is shown. In this embodiment, the member 54 is on the outside of the shirt 10 and not with the interior space 50 of the shirt 10. The member 54 is located substantially adjacent to the sleeve cutouts 36 and 42 and also the side edges 20 and 28 of the front panel 12 and rear panel 14, respectively.

As stated before, the elements mentioned in the previous paragraph may be incorporated on just one side of the shirt 10 or may be incorporated on both sides of the shirt 10. For example, FIGS. 4-6 show the member 54 located under the left side 11 of the shirt 10. However, alternatively or additionally, the member 54 may be located on the right side 13 of the shirt 10.

In sports such as golf, baseball, and tennis, the user seeks the development of an effective swing—an athletic swing that will prove successful in getting the club, bat or racquet to strike the ball with accuracy, power, and consistency. In attempting to deliver an effective athletic swing, it is advantageous if the arms of the athlete retain their connection to the body—up against, or in close proximity to the rib cage.

The benefit of the shirt 10 is that it helps the user to position and guide his arms and shoulders in the course of the swing. Rather than trying hard to remember and apply a long list of detailed instructions on how exactly to position oneself and on how to properly keep the upper arms connected to the body throughout the swing, the attached placement of the member 54 provides the user with a secured 'sensory guide' that does not drop to the ground or slide out of place as the golfer positions himself at address, and directs the turning and swinging of his shoulders and arms. As the 'body-mapping' inventive apparel organizes the muscles and provides the player with heightened sensory awareness, it allows him to swing basically by feel as opposed to becoming overly engaged in swing thoughts.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. A shirt for improving a swinging motion of a user wearing the shirt, the shirt comprising:

front and rear panels each having corresponding top, bottom and generally opposing side edges, wherein the front and rear panels are adjoined to each other by the top and side edges, defining an interior space of the shirt;

said front and rear panels including sleeve cutouts formed on each side edge adjacent the top edge, and a neck cutout formed on the top edges of the front and rear panels;

at least one tubular sleeve permanently joined to the front and rear panels of at least one of the sleeve cutouts, the tubular sleeve defining an inside area, the inside area being fluidly connected to the interior space of the shirt;

a member substantially adjacent to the sleeve cutout and the side edges of both the front and rear panels, wherein the member is located in a pouch within the inside area of the at least one tubular sleeve; and the pouch being substantially adjacent to the sleeve cutout and permanently coupled to the shirt, the pouch being in fluid communication with an opening configured to receive the flexible member for allowing the member to be easily inserted or removed from the pouch; and wherein positive sensory feedback is provided during the swinging motion by the member, for guiding an arm of the user substantially steadily on plane and substantially keeping the arm adjacent to a side of a chest of the user while allowing the arm of the user to move freely without being coupled to the chest of the user.

2. The shirt of claim 1, wherein the member is substantially cylindrical in shape.

3. The shirt of claim 2, wherein the member tapers at the ends of the flexible member.

4. The shirt of claim 1, wherein the member has a curvature corresponding the edges of at least one of the sleeve cutouts.

5. The shirt of claim 1, wherein the member is entirely located within the inside area of the at least one tubular sleeve or the interior area of the shirt.

6. The shirt of claim 1, further comprising at least two design lines coupled to the front panel of the shirt, the design lines extending substantially from the top edge of the front panel towards the bottom edge of the front panel.

7. The system of claim 1, wherein the member emits a visual, audible or tactile output.

8. The system of claim 1, wherein the member is a flexible member.

9. The system of claim 1, wherein the opening is nearer to the front panel of the shirt than to the back panel of the shirt.

10. The system of claim 1, wherein the opening is defined by portions of the front panel of the shirt.

* * * * *